US012577037B2

(12) United States Patent
Bennett

(10) Patent No.: US 12,577,037 B2
(45) Date of Patent: Mar. 17, 2026

(54) FLEXIBLE AND FOLDABLE LIQUID CONTAINMENT TRAY AND METHODS OF USING THE SAME

(71) Applicant: ABG Bag, Inc., Rockford, IL (US)

(72) Inventor: William Duffy Bennett, Chicago, IL (US)

(73) Assignee: ABG Bag, Inc., Rockford, IL (US)

( * ) Notice: Subject to any disclaimer, the term of this patent is extended or adjusted under 35 U.S.C. 154(b) by 0 days.

(21) Appl. No.: 17/068,635

(22) Filed: Oct. 12, 2020

(65) Prior Publication Data

US 2021/0107732 A1 Apr. 15, 2021

Related U.S. Application Data

(60) Provisional application No. 62/914,175, filed on Oct. 11, 2019.

(51) Int. Cl.

| | |
|---|---|
| ***B65D 33/02*** | (2006.01) |
| ***B65D 88/16*** | (2006.01) |
| ***B65D 90/24*** | (2006.01) |
| *B65D 30/00* | (2006.01) |
| *B65D 33/14* | (2006.01) |
| *B65D 33/28* | (2006.01) |

(52) U.S. Cl.

CPC ..... *B65D 88/1606* (2013.01); *B65D 33/02* (2013.01); *B65D 90/24* (2013.01); *B65D 29/00* (2013.01); *B65D 33/14* (2013.01); *B65D 33/28* (2013.01); *B65D 2590/24* (2013.01)

(58) Field of Classification Search

CPC ..... B65D 11/20; B65D 11/18; B65D 11/1846; B65D 11/1853; B65D 33/02; B65D 88/1606; B65D 90/24; B65D 2590/24; B65D 88/16–20; A45C 7/007

USPC .... 383/107, 119, 33, 4, 905; 220/9.1–9.4, 6, 220/666, 571–573; 229/117.07; 4/585

See application file for complete search history.

(56) References Cited

U.S. PATENT DOCUMENTS

| | | | | |
|---|---|---|---|---|
| 2,950,484 A * | 8/1960 | Jaffe | A47K 3/064 | 5/98.1 |
| 3,578,236 A * | 5/1971 | Arai | B65D 33/30 | 383/905 |
| 5,020,638 A * | 6/1991 | Smith | F16N 31/006 | 184/106 |
| 5,865,223 A * | 2/1999 | Cornford | B65D 90/24 | 141/86 |
| 8,777,001 B1 * | 7/2014 | Bennett | B65D 81/022 | 206/204 |
| 2014/0251990 A1 * | 9/2014 | Hopkins | B65D 90/24 | 220/4.12 |

* cited by examiner

*Primary Examiner* — Nathan J Newhouse
*Assistant Examiner* — Nina K Attel
(74) *Attorney, Agent, or Firm* — Scherrer Patent & Trademark Law, P.C.; Stephen T. Scherrer; Monique A. Morneault

(57) ABSTRACT

A containment tray for holding, transporting and/or storage of objects, such as, preferably, liquid-filled or, more preferably, oil-filled objects. More particularly, the invention relates to a containment tray capable of holding, transporting and/or storing liquid-filled industrial objects and preventing leaking of both hazardous and non-hazardous materials from such objects when in the containment tray into the outside environment.

15 Claims, 10 Drawing Sheets

FLEXIBLE AND FOLDABLE LIQUID CONTAINMENT TRAY AND METHODS OF USING THE SAME

The present invention claims priority to U.S. Provisional Patent Application No. 62/914,175 titled, "Flexible/Foldable Containment Tray," having a filing date of Oct. 11, 2019, which is hereby incorporated by reference in its entirety.

FIELD OF THE INVENTION

The present invention relates to a containment tray for holding, transporting and/or storage of objects and/or material, such as, preferably, liquid-filled or, more preferably, oil-filled objects. More particularly, the invention relates to a containment tray capable of holding, transporting and/or storing liquid-filled industrial objects and/or other material and preventing leaking of both hazardous and non-hazardous materials from such objects when in the containment tray into the outside environment.

BACKGROUND OF THE INVENTION

Industrial objects containing liquids are well-known. Indeed, typical liquid-filled industrial objects may contain oils, fuels, chemicals, and/or other like liquids that may be harmful to human health and/or the environment if released. Oftentimes, liquid-filled objects can accidentally release hazardous materials if mishandled or environmentally exposed. For example, liquid-filled objects are typically made of metal that can rust if left in a natural environment, causing release of the liquid contained therein.

In addition, liquid-filled objects may also accidentally release hazardous material during transport. Oftentimes, liquid-filled industrial objects may be difficult to move, requiring machinery that may jostle and/or break the liquid-filled objects, thereby releasing the liquids contained therein. In addition, liquid-filled objects may be stored long-term, thereby leading to neglect.

For example, electrical transformers such as of a type used in commercial, power distribution and industrial applications are typically constructed with the transformer coils located in a housing that is filled with liquid to achieve desired electrical insulation and thermal cooling characteristics. Liquids used for this purpose include various oil formulations and hazardous chemicals. In many instances, leaking of these fluids from transformers can cause environmental damage, violate certain civil codes, and result in the levying of significant fines. Another type of liquid-filled industrial object includes liquid-filled drums, such as oil drums or the like. Thus, there is an ever-present need to prevent leaking from these objects into the outside environment.

Liquid-filled industrial objects can start leaking for a number of common reasons, generally related to either damage to the object's housing or time in service, and as such, development of leaks are often not preventable. For electrical transformers, for example, by the time maintenance personnel reaches a leaking transformer, the leaking of fluid will have typically stopped. The significant problem for the maintenance personnel is to remove the leaking transformer and return it to a repair facility without leaking additional fluid. Thus, a cause of transformers needlessly leaking fluid into the outside environment is during the course of handling a leaking transformer, including removal of the installed transformer and transport of the transformer to a repair facility. During transport to a storage or repair facility, such as in the back of a repair truck, the transformers or other liquid-filled industrial objects can experience significant bouncing and "knocking-around" during which prior solutions provide no protection.

It is often difficult to arrive at a solution for containing, holding, storing and/or transporting liquid-filled industrial objects, such as the afore-mentioned transformers and/or other like objects and/or material. It is often difficult to utilize a tray or containment solution that is flexible and is easily stored, yet opens to adequately house a liquid-filled object. Moreover, it is often difficult to utilize a tray that opens and rigidly holds itself in an open position, ready to receive a liquid-filled object. Further, when placed within a containment bag or tray, it is often difficult to hold and prevent the spread and/or release of liquid released from the liquid-filled object. Still further, it is often difficult to adequately contain leaks therefrom with current solutions, especially during transport thereof.

A need, therefore, exists for an improved containment tray for liquid-filled industrial objects. Specifically, a need exists for an improved containment tray for holding, storing and/or transporting liquid-filled objects and/or other like objects and/or materials. More specifically, a need exists for an improved containment tray that is flexible and easily stored, yet opens to adequately house a liquid-filed object.

Moreover, a need exists for an improved containment tray that opens and rigidly holds itself in an open position, ready to receive a liquid-filled object. Further, a need exists for an improved containment tray for a liquid-filled industrial object that holds and prevents the spread and/or release of liquid released from the liquid-filled object. Still further, a need exists for an improved containment tray for liquid-filled industrial objects that adequately contains leaks therefrom, especially during transport thereof.

The present invention addresses the above-identified and other known drawbacks and disadvantages of prior solutions.

SUMMARY OF THE INVENTION

The present invention relates to a containment tray for holding, transporting and/or storage of objects, such as, preferably, liquid-filled or, more preferably, oil-filled objects. More particularly, the invention relates to a containment tray capable of holding, transporting and/or storing liquid-filled industrial objects and preventing leaking of both hazardous and non-hazardous materials from such objects when in the containment tray into the outside environment.

To this end, in an embodiment of the present invention, a containment tray apparatus for containing material therein is provided. The containment tray apparatus comprises: a base formed from a flexible and liquid impervious fabric material; and a first flexible side wall extending perpendicularly from the base; a second flexible side wall connected to the first side wall and extending perpendicularly from the base, wherein the first side wall and the second side wall form a corner where connected together; and a bendable insert strip disposed within the first flexible side wall, within the second flexible side wall, and around the corner between the first flexible side wall and the second flexible side wall; wherein the base is configured to hold material therein within the first and second side walls.

In an embodiment, the containment tray apparatus further comprises: an absorbent material on a top surface of the base.

In an embodiment, the containment tray apparatus further comprises: a first fold line in the first side wall extending angularly from a corner to a top of the first side wall, wherein the first fold line is configured to fold to allow the first side wall and the second side wall to fold inwardly toward the base and bending the bendable insert strap at the first fold line and the corner, thereby flattening the first side wall and the second side wall.

In an embodiment, the containment tray apparatus further comprises a first flat rigid insert within the first side wall; and a second flat rigid insert within the second side wall, wherein the first flat rigid insert is configured to hold the first side wall rigidly and the second flat rigid insert is configured to hold the second side wall rigidly.

In an embodiment, the containment tray apparatus further comprises: a duffel extending upwardly from the first side wall and the second wall.

In an embodiment, the duffel comprises a cinch line disposed near a top of the duffel, wherein the cinch line is configured to allow tightening of the duffel around the material contained on the base.

In an embodiment, the containment tray apparatus further comprises: at least one strap extending from the first side wall configured to hold the material on the base.

In an embodiment, the base is made from a geotextile fabric.

In an embodiment, the base and first and second side walls comprise a first layer of a geotextile fabric and a second layer of a liquid impervious plastic sheet.

In an embodiment, the base comprises four sides, and the containment tray apparatus further comprises: a third flexible side wall connected to the second side wall and extending perpendicularly from the base, wherein the third side wall and the second side wall form a second corner where connected together; and a fourth flexible side wall connected to the first side wall and the third side wall and extending perpendicularly from the base, wherein the fourth side wall and the third side wall form a third corner where connected together and wherein the fourth side wall and the first side wall form a fourth corner where connected together.

In an alternate embodiment of the present invention, a method of using a flexible containment tray apparatus is provided. The method comprises the steps of: providing a flexible containment tray apparatus comprising: base formed from a flexible and liquid impervious fabric material; a first flexible side wall extending perpendicularly from the base; a second flexible side wall connected to the first side wall and extending perpendicularly from the base, wherein the first side wall and the second side wall form a corner where connected together; and a bendable insert strip disposed within the first flexible side wall, within the second flexible side wall, and around the corner between the first flexible side wall and the second flexible side wall; wherein the base is configured to hold material therein within the first and second side walls; and placing the material onto the base and holding the material on the base within the first side wall and the second side wall.

In an embodiment, the base comprises an absorbent material on a top surface of the base.

In an embodiment, a first fold line in the first side wall extends angularly from a corner to a top of the first side wall, wherein the first fold line is configured to fold to allow the first side wall and the second side wall to fold inwardly toward the base and bending the bendable insert strap at the first fold line and the corner, thereby flattening the first side wall and the second side wall.

In an embodiment, the containment tray apparatus further comprises: a first flat rigid insert within the first side wall; and a second flat rigid insert within the second side wall, wherein the first flat rigid insert is configured to hold the first side wall rigidly and the second flat rigid insert is configured to hold the second side wall rigidly.

In an embodiment, the containment tray apparatus further comprises a duffel extending upwardly from the first side wall and the second wall, the method further comprises the step of: holding the material within the containment tray apparatus on the base and within the duffel.

In an embodiment, the duffel comprises a cinch line disposed near a top of the duffel, wherein the cinch line is configured to allow tightening of the duffel around the material contained on the base, the method further comprises the step of: cinching the duffel around the material contained within the containment tray apparatus on the base and within the duffel.

In an embodiment, the containment tray apparatus further comprises at least one strap extending from the first side wall configured to hold the material on the base, the method further comprises the step of: extending the strap around the material within the containment tray apparatus on the base.

In an alternate embodiment of the present invention, a method of using a foldable and flexible containment tray is provided. The method comprises the steps of: providing a flexible containment tray apparatus comprising: base formed from a flexible and liquid impervious fabric material; a first flexible side wall extending perpendicularly from the base; a second flexible side wall connected to the first side wall and extending perpendicularly from the base, wherein the first side wall and the second side wall form a corner where connected together; a bendable insert strip disposed within the first flexible side wall, within the second flexible side wall, and around the corner between the first flexible side wall and the second flexible side wall; and a first fold line in the first side wall extending angularly from a corner to a top of the first side wall, wherein the first fold line is configured to fold to allow the first side wall and the second side wall to fold inwardly toward the base thereby flattening the first side wall and the second side wall; wherein the base is configured to hold material therein within the first and second side walls; folding the first side wall at the first fold line; and pushing the first side wall and the second side wall inwardly toward the base thereby flattening the first side wall and the second side wall.

In an embodiment, the method further comprises the step of: folding the base along a first base fold line to form a folded containment tray apparatus.

In an embodiment, the method further comprises the step of: folding the folded containment tray apparatus along a second base fold line to form a double-folded containment tray apparatus.

It is, therefore, an advantage and objective of the present invention to provide an improved containment tray for liquid-filled industrial objects.

Specifically, it is an advantage and objective of the present invention to provide an improved containment tray for holding, storing and/or transporting liquid-filled objects.

More specifically, it is an advantage and objective of the present invention to provide an improved containment tray that is flexible and easily stored, yet opens to adequately house a liquid-filed object.

Moreover, it is an advantage and objective of the present invention to provide an improved containment tray that opens and rigidly holds itself in an open position, ready to receive a liquid-filled industrial object.

Further, it is an advantage and objective of the present invention to provide an improved containment tray for a liquid-filled industrial object that holds and prevents the spread and/or release of liquid released from the liquid-filled object.

Still further, it is an advantage and objective of the present invention to provide an improved containment tray for liquid-filled industrial objects that adequately contains leaks therefrom, especially during transport thereof.

Additional features and advantages of the present invention are described in, and will be apparent from, the detailed description of the presently preferred embodiments and from the drawings.

These and other objectives and advantages of the invention will become more apparent from the following detailed description when taken in conjunction with the accompanying drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

Figure 1:
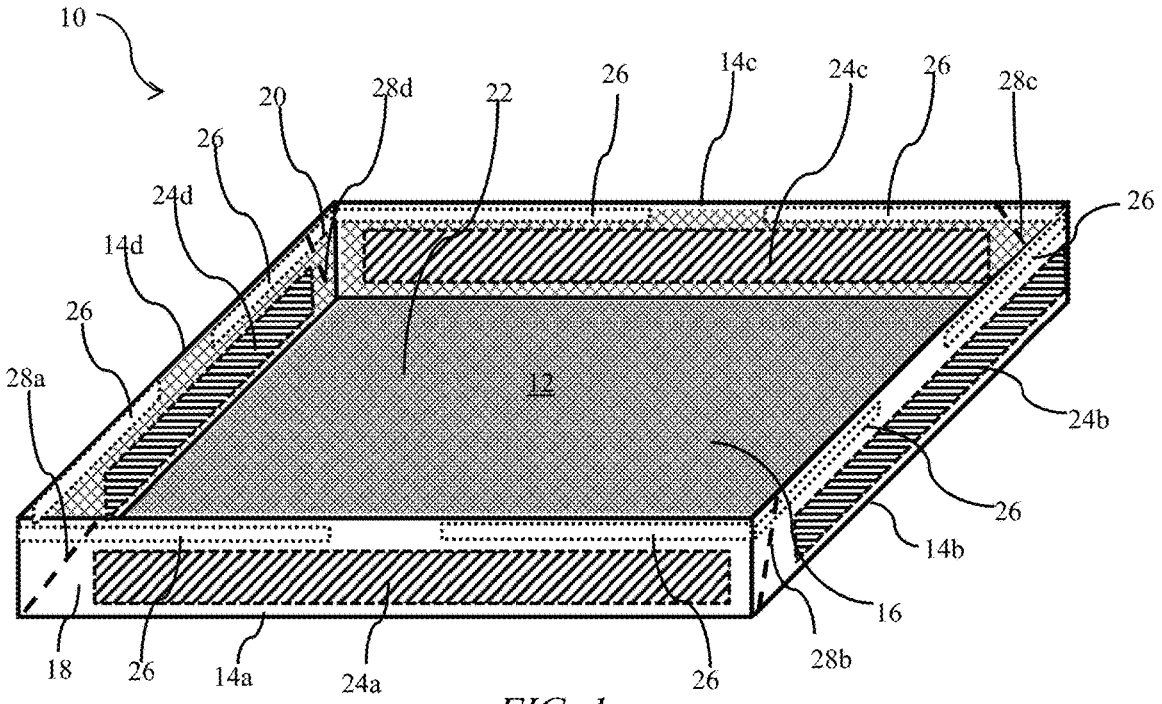
FIG. 1 is a perspective view of a flexible and foldable containment tray in an embodiment of the present invention.

While the invention is susceptible of various modifications and alternative constructions, a certain embodiment is shown in the drawings and described in detail below. It should be understood, however, that there is no intention to limit the invention to the specific form disclosed, but on the contrary, the intention is to cover all modifications, alternative constructions and methods, and equivalents falling within the spirit and scope of the invention.

DETAILED DESCRIPTION OF THE INVENTION

The present invention relates to a containment tray for holding, transporting and/or storage of objects, such as, preferably, liquid-filled or, more preferably, oil-filled objects. More particularly, the invention relates to a containment tray capable of holding, transporting and/or storing liquid-filled industrial objects and preventing leaking of both hazardous and non-hazardous materials from such objects when in the containment tray into the outside environment.

Figure 3:
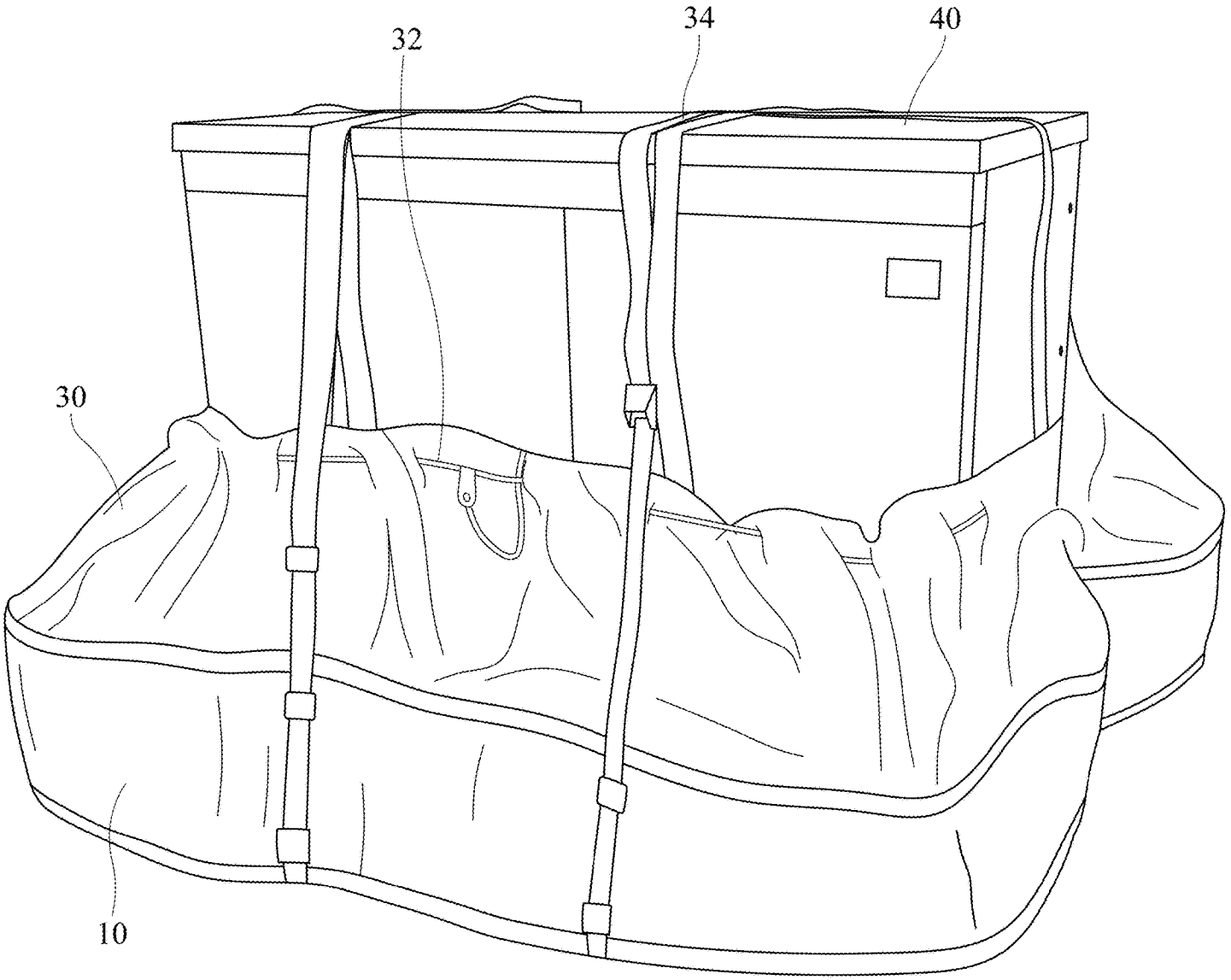
FIG. 3 illustrates a perspective view of a flexible and foldable containment tray with a duffel and a liquid-filled industrial object in an embodiment of the present invention.

Referring now to FIG. 1, a flexible and foldable containment tray 10 is illustrated in an embodiment of the present invention. The flexible and foldable containment tray 10 comprises a base 12 and sides 14*a*, 14*b*, 14*c* and 14*d*. Generally, the flexible and foldable containment tray 10 comprises an open top 16 for the placement of an industrial object therein, as illustrated in FIG. 3. The base 12 is generally square in shape, as illustrated in FIG. 1, but may be any shape useful to hold an industrial object therein.

The containment tray 10 is made from liquid impervious fabric material that may have sufficient strength to hold an industrial object therein without breaking or tearing. Preferably, the containment tray 10 may be made from a heavy duty geotextile material. There may be multiple layers of materials for different purposes within the containment tray. For example, the outer layer may be the heavy duty geotextile material, and an inner layer may be a liquid impervious plastic sheeting material which may be stitched or otherwise adhered together. On the base 12 may be an absorbent pad 22 that may be useful for absorbing liquid that may leak or spill from liquid-filled industrial objects. Generally, the absorbent pad 22 may be the same shape and size of the base 12 to fully cover the base.

To aid in maintaining a certain degree of rigidity in the containment tray 10, and to aid in keeping the sides 14*a*-14*d* upright, especially when loading an industrial object therein, a plurality of inserts 24*a*, 24*b*, 24*c* and 24*d* may be disposed internally within sides 14*a*, 14*b*, 14*c* and 14*d*, respectively. The plastic inserts may be relatively rigid plastic plates or sheets, but may also include other inserts made from other materials, such as cardboard, wood, metal, or other like material, and the present invention should not be limited as described herein.

Figure 4:
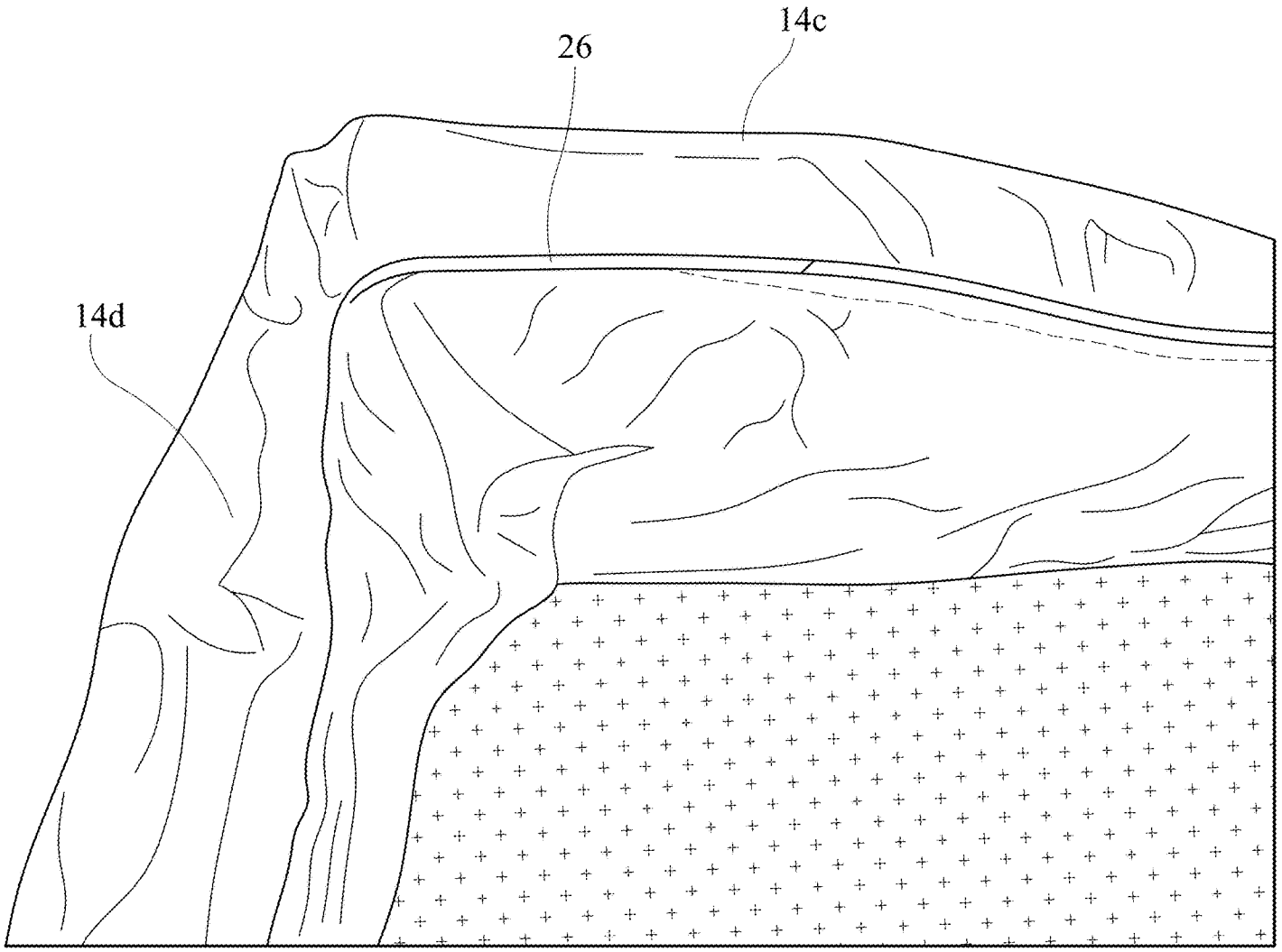
FIG. 4 illustrates a perspective view of a corner of a flexible and foldable containment tray in an embodiment of the present invention.

Disposed around a top periphery of the sides 14*a*-14*d* and near the corners thereof may be rigid bendable inserts 26 that may keep the sides 14*a*-14*d* upright and maintain the opening for the open top 16. Rigid bendable inserts 26 are preferably made from a bendable material that retain its shape after being bent, such as, preferably, metal strips, and may extend from one of the sides around each corner and into another adjacent side thereof. As illustrated in FIG. 4, the rigid bendable inserts may be disposed on an inside of each corner and wrap around the inside of each corner to provide rigidity for each corner to maintain the sides upright and in an open configuration. As illustrated, the rigid bendable inserts may be disposed within each side and near a top of each of the sides, and exposed near the corners thereof to allow a user to manipulate the same when folding the corners to fold into a folded configuration, as described below and illustrated in FIGS. 5A-5G. It should be noted, however, that the rigid bendable insert may be disposed entirely within the sides and the corner and not visible and the invention should not be limited as described herein. Moreover, each of the rigid bendable inserts may terminate near the center of each of the sides to provide a gap therebetween to aid in folding the containment tray, as described below with reference to FIGS. 5A-5G.

The rigid bendable inserts provides sufficient strength to maintain its rigidity when utilized, but may be sufficiently malleable to allow the corners to be folded as described below. In a preferred embodiment, the rigid bendable insert may be a stainless steel strip T304 annealed with round edge, although the present invention should not be limited.

Diagonal fold lines 28*a*, 28*b*, 28*c* and 28*d* may be disposed in the sides 14*a*, 14*b*, 14*c* and 14*d*, respectively, which may allow the sides 14*a*-14*d* to fold inwardly thereby flattening the containment tray 10 for easy folding and storage thereof. A method for folding each of the sides 14*a*-14*d* and folding the containment tray 10 into a compact and storable size and shape is illustrated in FIGS. 5A-5G, and described in more detail below.

Figure 2:
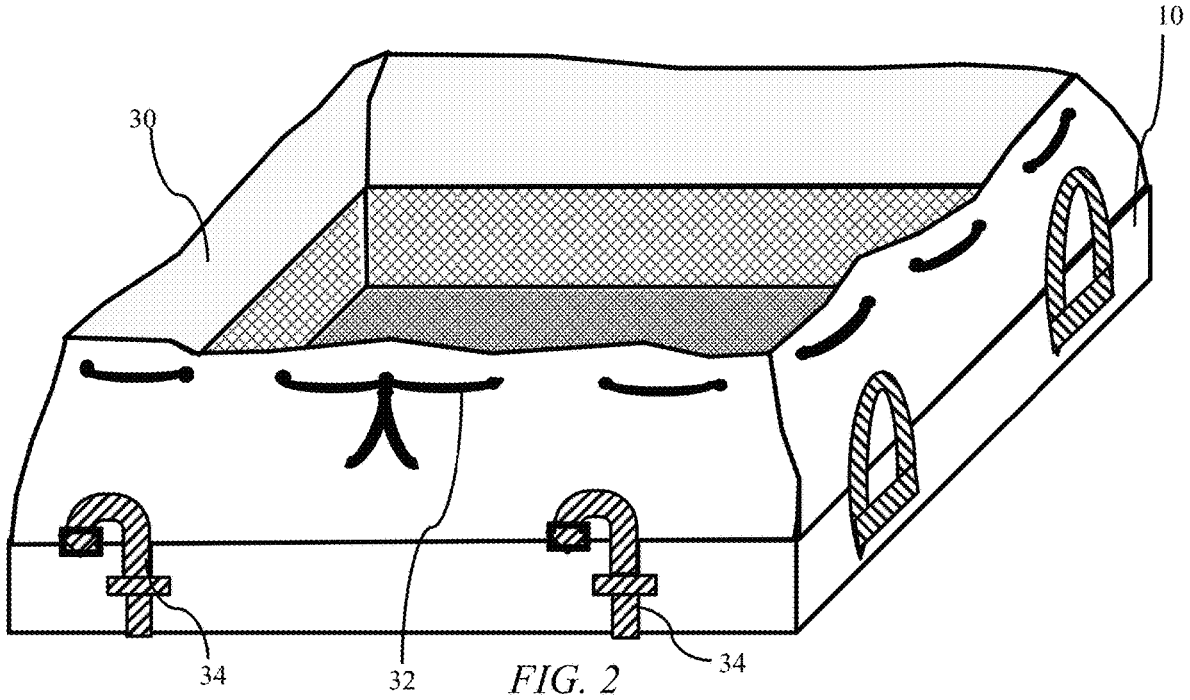
FIG. 2 illustrates a perspective view of a flexible and foldable containment tray with a duffel in an embodiment of the present invention.

The containment tray 10 may also have an optional duffel top 30, illustrated in more detail in FIGS. 2 and 3. The duffel top 30 may be disposed around the top edges of each of the sides 14*a*-14*d* to extend the height of each of the sides 14*a*, 14*d*. However, the duffel 30 may be flexible, and have a draw string 32 wrapped therethrough adjacent a top thereof to allow an industrial object to be placed therein and cinched therearound to hold the industrial object in place and/or to prevent liquids, such as oils or other like fluids, that may be contained therein from splashing out of the containment tray 10, especially during transport thereof. Straps 34 having buckles or other connection elements may be disposed around the periphery of the containment tray 10, which may loop around industrial objects thereby holding the industrial objects in place within the duffel 30 and within the containment tray 10. FIG. 3 illustrates a containment tray 10 with a duffel 30 cinched around an industrial object 40 that may be contained therein. The straps 34 may extend from each of the sides 14*a*-14*d* to hold the industrial object 40 in place within the containment tray 10.

The straps 34 may extend underneath the containment tray 10 from one side of the containment tray 10 to an opposite side, and then may extend up over the object 40, thereby holding the industrial object 40 in place within the containment tray 10. Preferably, the straps 34 are stitched to the underside of the flexible containment tray 10 to provide further strength and resilience to the straps 34 extending from the sides thereof and providing reinforcement for the containment tray 10 as it holds an object therein. Thus, an object 40 may be adequately held in place via the straps 34 and the duffel 30 may be extended to help contain the object 40 and any fluids that may be contained within the containment tray 10 that may leak from the object 40. This may be particularly useful for lifting and/or transporting the containment tray 10 having the object 40 disposed therein.

Figure 5A:
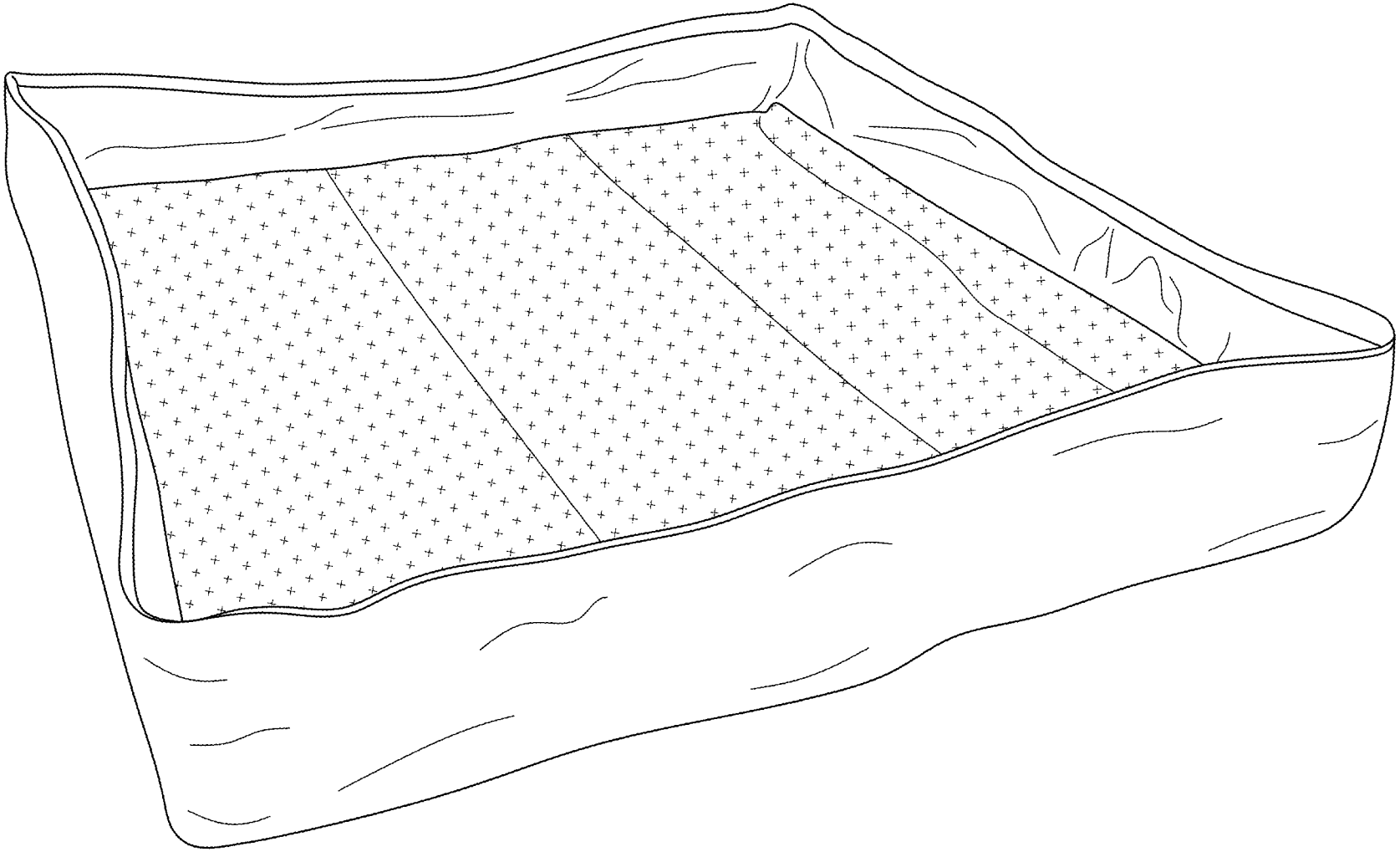
FIGS. 5A-5G illustrate a methodology of folding a flexible and foldable containment tray in an embodiment of the present invention.
Figure 5B:
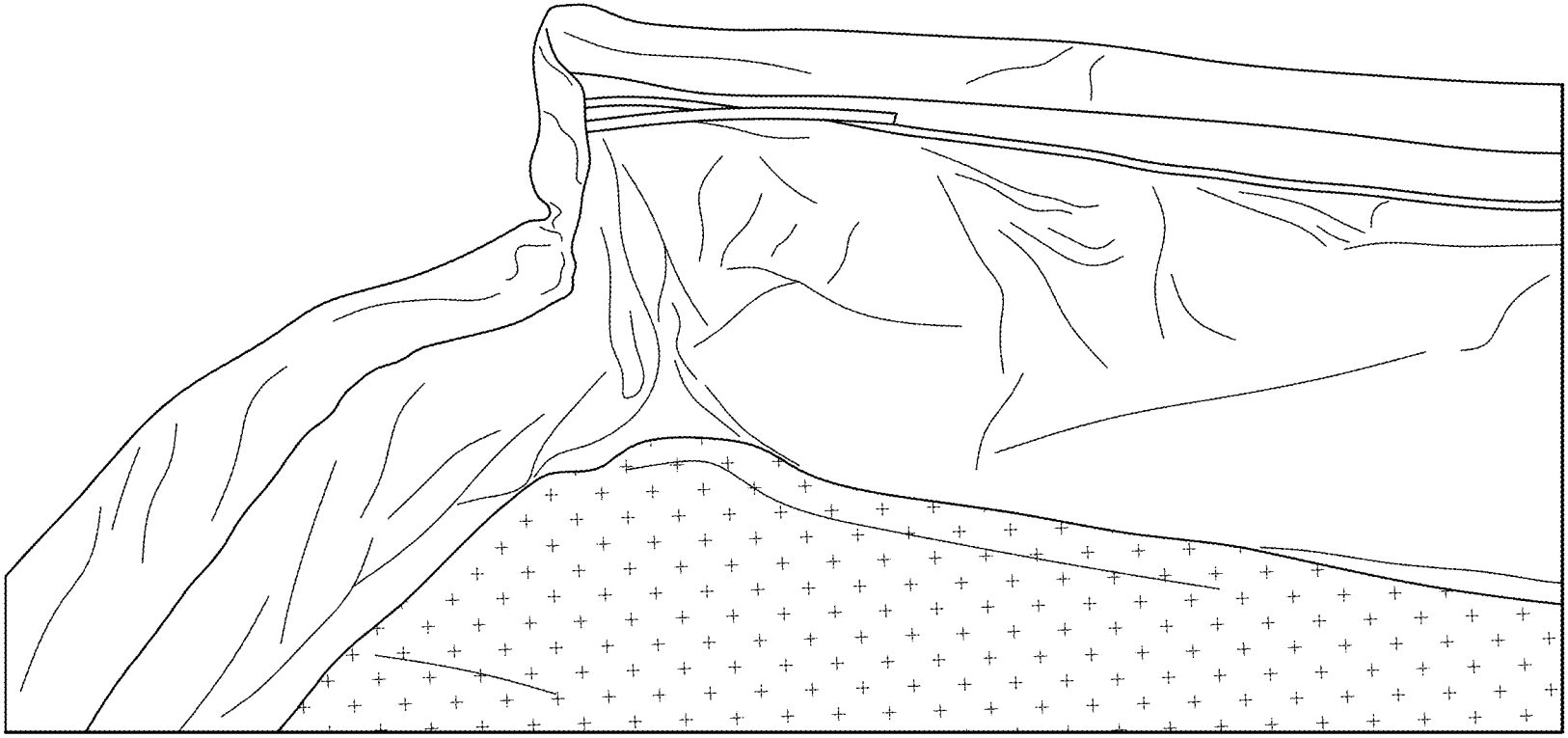
Figure 5C:
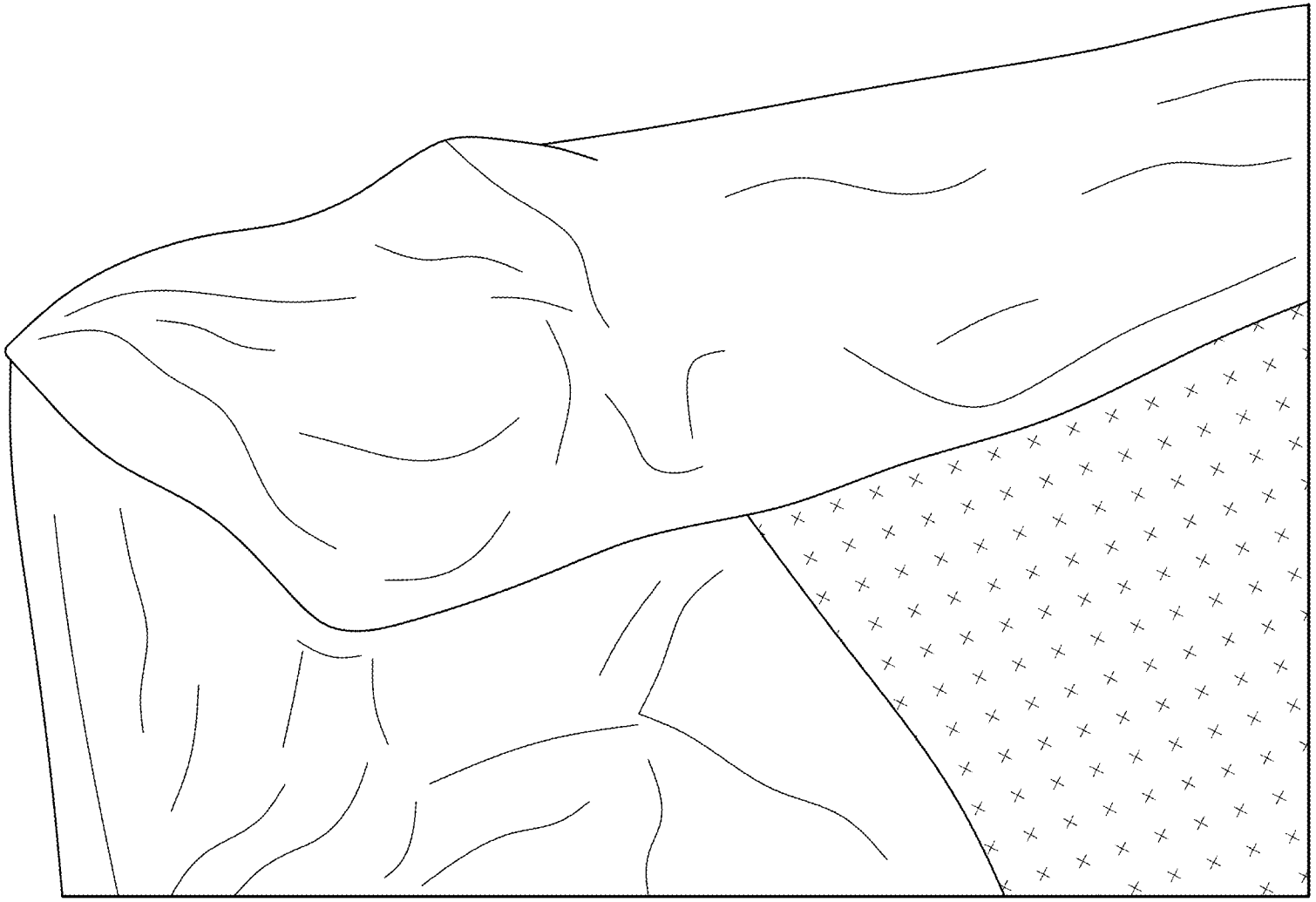
Figure 5D:
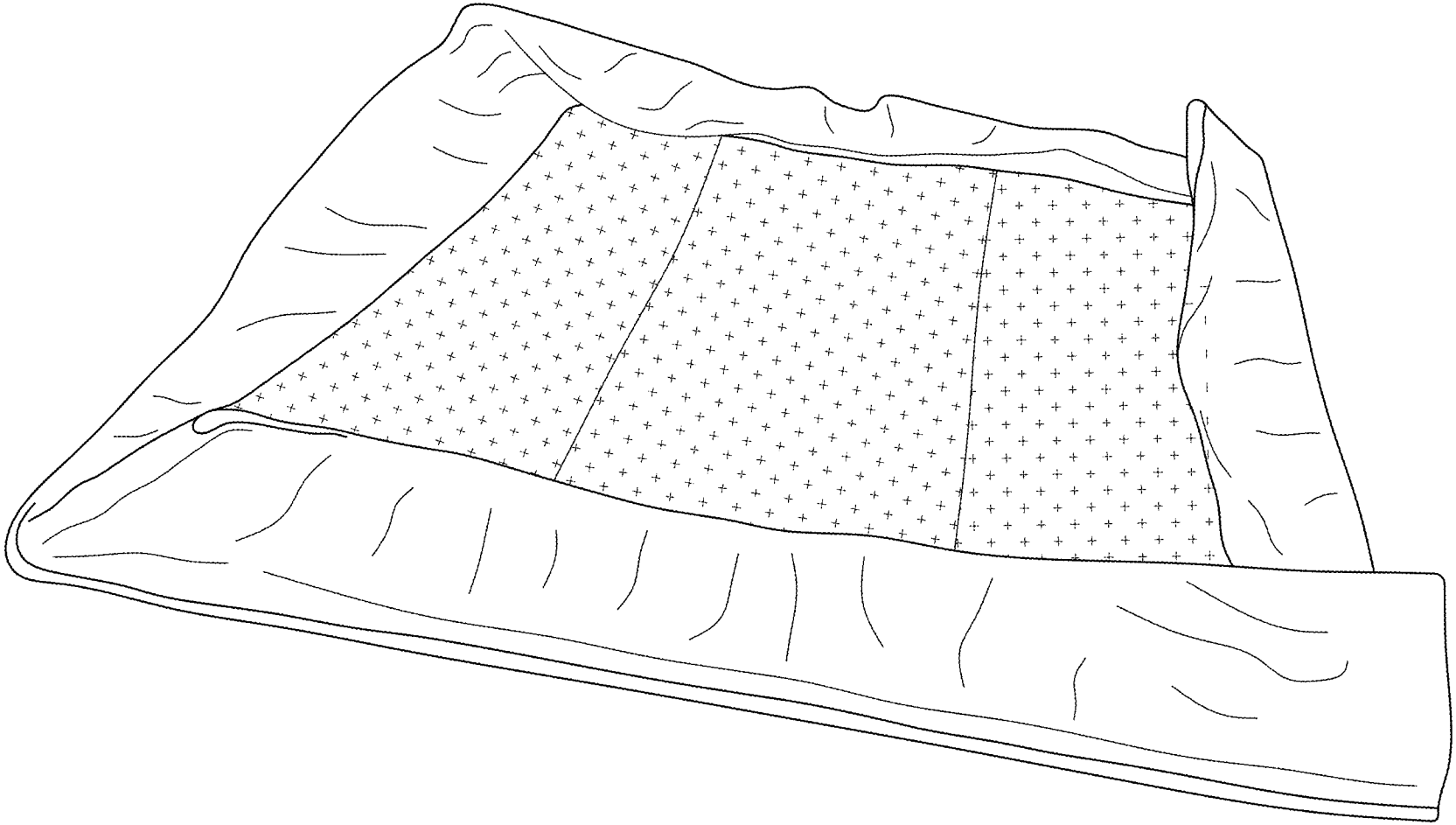

FIGS. 5A-5G illustrate a method of folding containment tray 10 in an embodiment of the present invention. Specifically, containment tray 10 may be emptied of any material or industrial objects as shown in FIG. 5A. Each of the sides 14*a*-14*d* may be folded as illustrated in FIGS. 5B-5C. Specifically, fold lines 28*a*-28*d* may be folded within each side 14*a*-14*d*, respectively, and the closest adjacent side to each fold line may be pushed inwardly, thereby flattening both sides. The metal inserts 26 may be bent at each fold location. Specifically, as shown in FIG. 5C, fold line 28*a* may be folded, causing sides 14*a* and 14*d* to be flattened. Once done on each corner, all of the sides 14*a*-14*d* may be flattened, as illustrated in FIG. 5D.

Figure 5E:
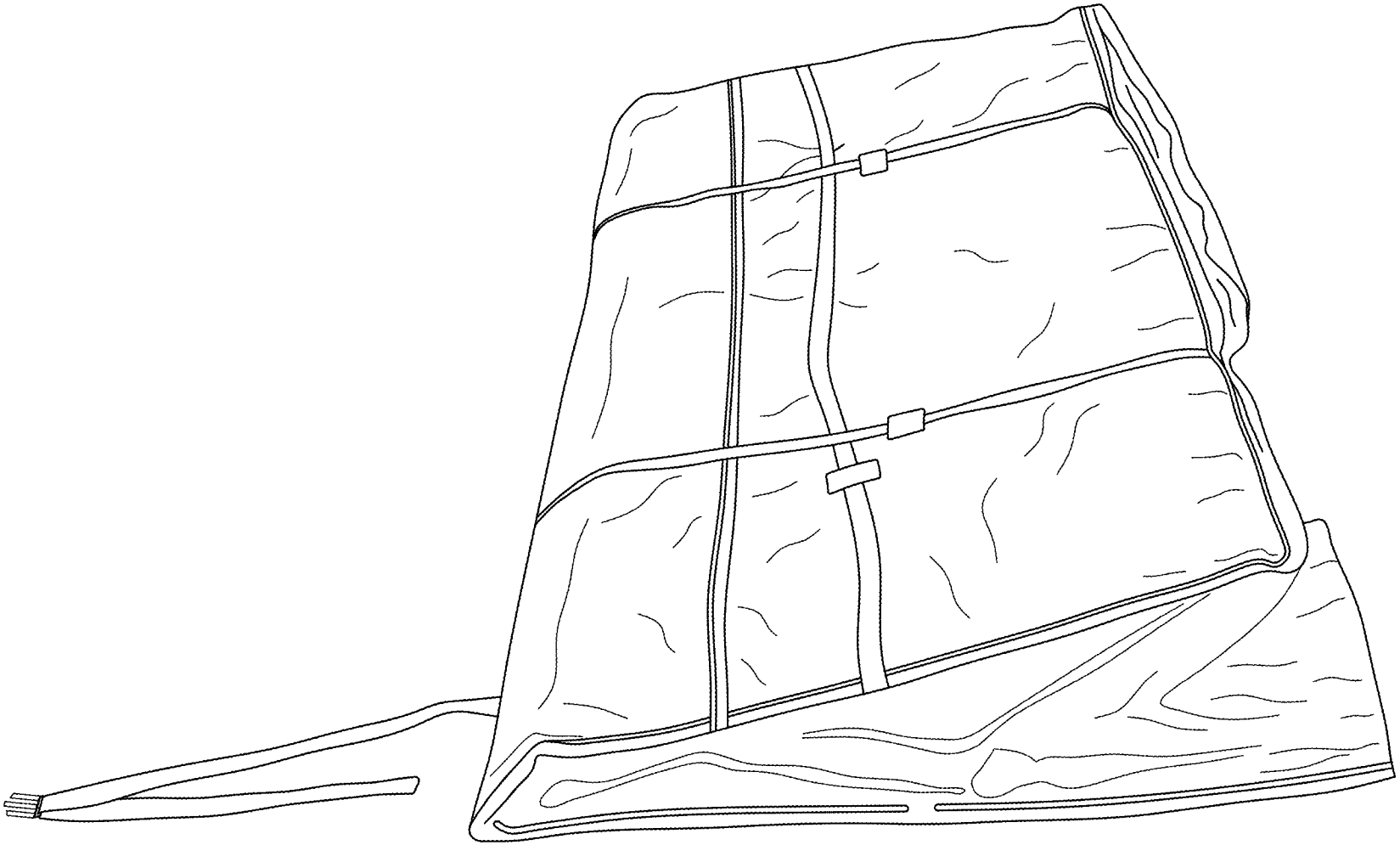
Figure 5F:
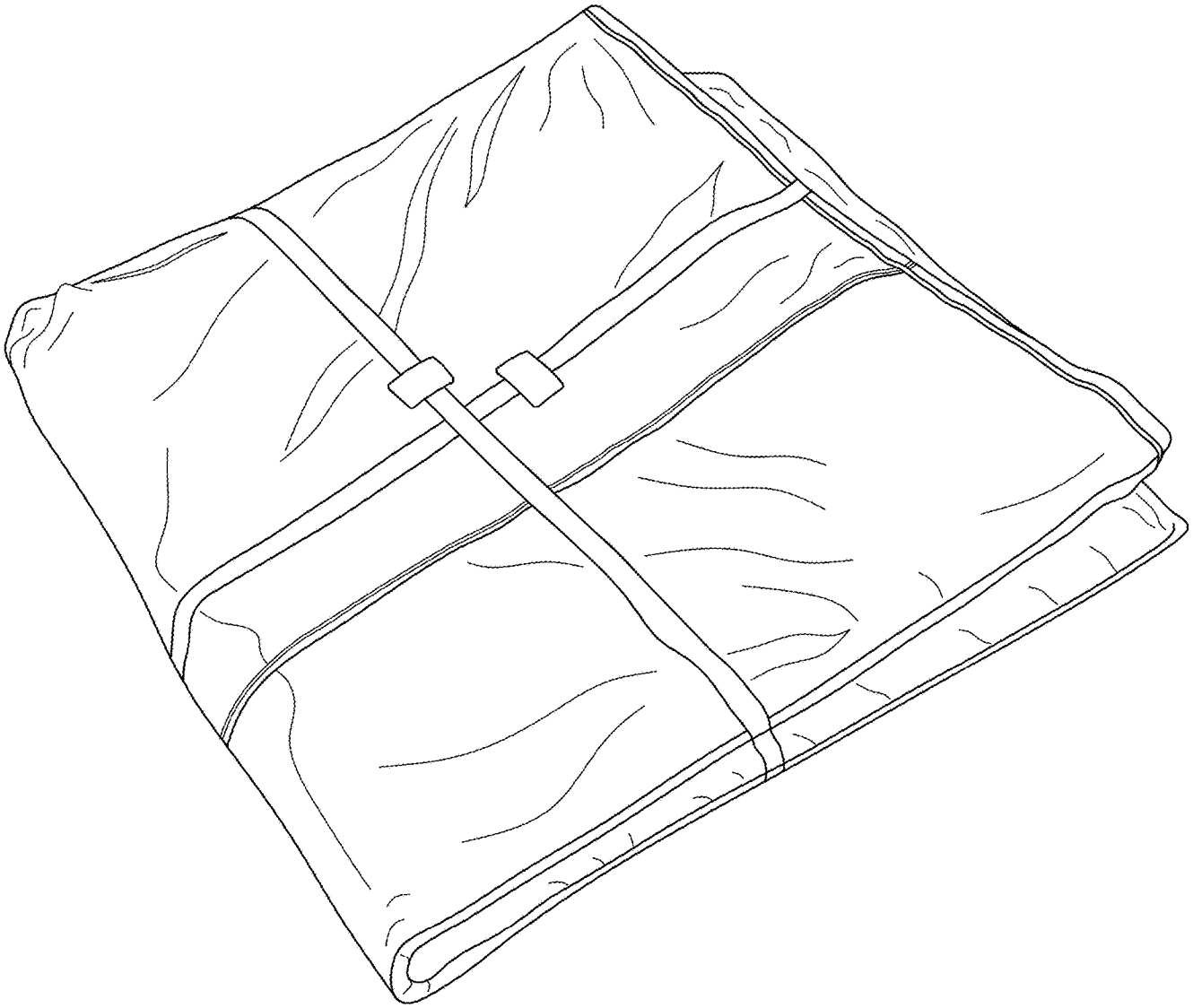
Figure 5G:
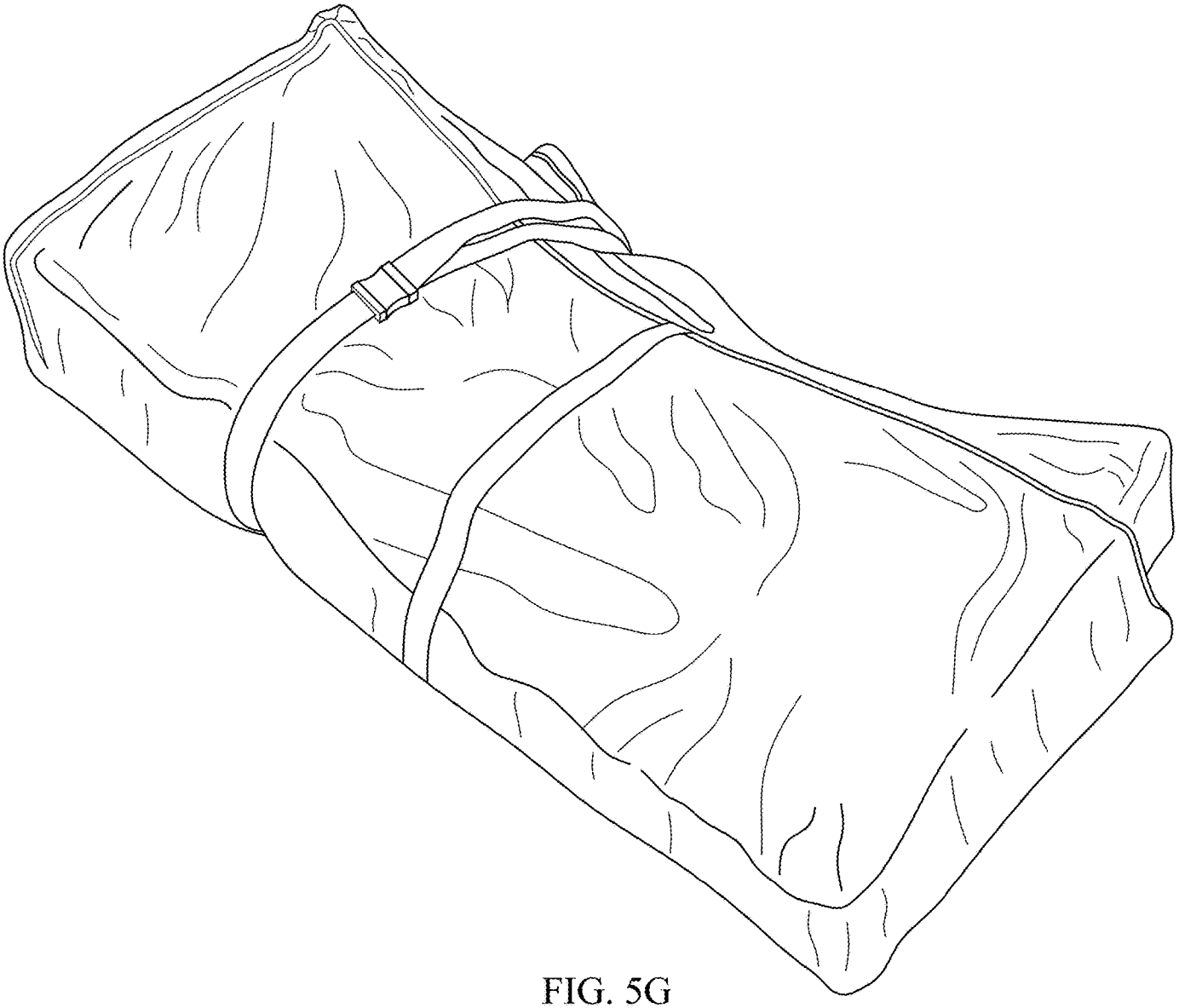

Once flattened, as shown in FIG. 5D, one side of the containment tray 10 may be folded over to the other side, as shown in FIG. 5E via fold line 50 to form a folded containment tray 52. As shown in FIG. 5F, one side of the folded containment tray 52 may be folded over to the other side thereof via fold line 54 to form double folded containment tray 56. As shown in FIG. 5G, one side of the double folded containment tray 56 may be folded over to the other side thereof via fold line 58 to form triple-folded containment tray 60, which may then be held in the triple-folded state via strap 62. The triple-folded containment tray 60 may be easily transported and stored as necessary.

For unfolding and utilizing the containment tray 10, the above-referenced steps may be completed in reverse, thereby forming opened flexible and foldable containment tray 10 shown in FIG. 5A, ready to receive material therein, such as liquid-filled industrial objects, as described herein.

From the foregoing, it will be apparent that the containment bag is uniquely capable of receiving a liquid-filled industrial object, or any other material, as necessary, carrying and moving the same using the straps and webbing loops, and enclosing and storing the same without leaking from the containment tray 10.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A containment tray apparatus for containing material therein, the apparatus comprising:

a base formed from a flexible and liquid impervious fabric material;

a first flexible side wall extending perpendicularly from the base;

a second flexible side wall connected to the first flexible side wall and extending perpendicularly from the base, wherein the first flexible side wall and the second flexible side wall form a first corner where connected together;

a third flexible side wall connected to the second flexible side wall and extending perpendicularly from the base, wherein the third flexible side wall and the second flexible side wall form a second corner where connected together;

a fourth flexible side wall connected to the first flexible side wall and the third flexible side wall and extending perpendicularly from the base, wherein the fourth flexible side wall and the third flexible side wall form a third corner where connected together and wherein the fourth flexible side wall and the first flexible side wall form a fourth corner where connected together;

a first bendable insert strip disposed within the first flexible side wall, within the second flexible side wall, and around the first corner between the first flexible side wall and the second flexible side wall;

a second bendable strip disposed within the second flexible side wall, within the third flexible side wall, and around the second corner between the second flexible side wall and the third flexible side wall;

a third bendable strip disposed within the third flexible side wall, within the fourth flexible side wall, and around the third corner between the third flexible side wall and the fourth flexible side wall;

a fourth bendable strip disposed within the fourth flexible side wall, within the first flexible side wall, and around the fourth corner between the fourth flexible side wall and the first flexible side wall;

wherein the base is configured to hold a liquid-filled industrial object therein during transport within a space formed by the first and second flexible side walls;

a first fold line in the first flexible side wall extending angularly from a first location at a bottom of the first flexible side wall adjacent the first corner to a second location at a top of the first flexible side wall, wherein the first fold line and the first corner are configured to fold along the first fold line and the first corner to allow the first flexible side wall and the second flexible side wall to fold downward and inwardly toward the base and further wherein the first bendable insert strip is configured to fold at the first fold line and the first corner thereby flattening the first flexible side wall and the second flexible side wall toward the base;

a second fold line in the second flexible side wall extending angularly from a third location at a bottom of the second flexible side wall adjacent the second corner to a fourth location at a top of the second flexible side wall, wherein the second fold line and the second corner are configured to fold along the second fold line and the second corner to allow the second flexible side wall and the third flexible side wall to fold downward and inwardly toward the base and further wherein the second bendable insert strip is configured to fold at the second fold line and the second corner thereby flattening the second flexible side wall and the third flexible side wall toward the base;

a third fold line in the third flexible side wall extending angularly from a fifth location at a bottom of the third flexible side wall adjacent the third corner to a sixth location at a top of the third flexible side wall, wherein the third fold line and the third corner are configured to fold along the third fold line and the third corner to allow the third flexible side wall and the fourth flexible side wall to fold downward and inwardly toward the base and further wherein the third bendable insert strip is configured to fold at the third fold line and the third corner thereby flattening the third flexible side wall and the fourth flexible side wall toward the base; and a fourth fold line in the fourth flexible side wall extending angularly from a seventh location at a bottom of the fourth flexible side wall adjacent the fourth corner to an eighth location at a top of the fourth flexible side wall, wherein the fourth fold line and the fourth corner are configured to fold along the fourth fold line and the fourth corner to allow the fourth flexible side wall and the first flexible side wall to fold downward and inwardly toward the base and further wherein the fourth bendable insert strip is configured to fold at the fourth fold line and the fourth corner thereby flattening the fourth flexible side wall and the first flexible side wall toward the base.

2. The containment tray apparatus of claim 1 further comprising:

an absorbent material on a top surface of the base.

3. The containment tray apparatus of claim 1 further comprising:

a duffel extending upwardly from the first flexible side wall and the second flexible side wall.

4. The containment tray apparatus of claim 3 wherein the duffel comprises a cinch line disposed near a top of the duffel, wherein the cinch line is configured to allow tightening of the duffel around the material contained on the base.

5. The containment tray apparatus of claim 1 further comprising:

at least one strap extending from the first flexible side wall configured to hold the liquid-filled industrial object on the base.

6. The containment tray apparatus of claim 1 wherein the base is made from a geotextile fabric.

7. The containment tray apparatus of claim 1 wherein the base and first and second flexible side walls comprise a first layer of a geotextile fabric and a second layer of a liquid impervious plastic sheet.

8. A method of using a flexible containment tray apparatus comprising the steps of:

providing the flexible containment tray apparatus comprising:

a base formed from a flexible and liquid impervious fabric material;

a first flexible side wall extending perpendicularly from the base;

a second flexible side wall connected to the first flexible side wall and extending perpendicularly from the base, wherein the first flexible side wall and the second flexible side wall form a first corner where connected together;

a third flexible side wall connected to the second flexible side wall and extending perpendicularly from the base, wherein the third flexible side wall and the second flexible side wall form a second corner where connected together;

a fourth flexible side wall connected to the first flexible side wall and the third flexible side wall and extending perpendicularly from the base, wherein the fourth flexible side wall and the third flexible side wall form a third corner where connected together and wherein the fourth flexible side wall and the first flexible side wall form a fourth corner where connected together;

a first bendable insert strip disposed within the first flexible side wall, within the second flexible side wall, and around the first corner between the first flexible side wall and the second flexible side wall;

a second bendable strip disposed within the second flexible side wall, within the third flexible side wall, and around the second corner between the second flexible side wall and the third flexible side wall;

a third bendable strip disposed within the third flexible side wall, within the fourth flexible side wall, and around the third corner between the third flexible side wall and the fourth flexible side wall;

a fourth bendable strip disposed within the fourth flexible side wall, within the first flexible side wall, and around the fourth corner between the fourth flexible side wall and the first flexible side wall;

wherein the base is configured to hold a liquid-filled industrial object therein during transport within the first and second flexible side walls;

a first fold line in the first flexible side wall extending angularly from a first location at a bottom of the first flexible side wall adjacent the first corner to a second location at a top of the first flexible side wall, wherein the first fold line and the first corner are configured to fold along the first fold line and the first corner to allow the first flexible side wall and the second flexible side wall to fold downward and inwardly toward the base and further wherein the first bendable insert strip is configured to fold at the first fold line and the first corner thereby flattening the first flexible side wall and the second flexible side wall toward the base;

a second fold line in the second flexible side wall extending angularly from a third location at a bottom of the second flexible side wall adjacent the second corner to a fourth location at a top of the second flexible side wall, wherein the second fold line and the second corner are configured to fold along the second fold line and the second corner to allow the second flexible side wall and the third flexible side wall to fold downward and inwardly toward the base and further wherein the second bendable insert strip is configured to fold at the second fold line and the second corner thereby flattening the second flexible side wall and the third flexible side wall toward the base;

a third fold line in the third flexible side wall extending angularly from a fifth location at a bottom of the third flexible side wall adjacent the third corner to a sixth location at a top of the third flexible side wall, wherein the third fold line and the third corner are configured to fold along the third fold line and the third corner to allow the third flexible side wall and the fourth flexible side wall to fold downward and inwardly toward the base and further wherein the third bendable insert strip is configured to fold at the third fold line and the third corner thereby flattening the third flexible side wall and the fourth flexible side wall toward the base;

a fourth fold line in the fourth flexible side wall extending angularly from a seventh location at a bottom of the fourth flexible side wall adjacent the fourth corner to an eighth location at a top of the fourth flexible side wall, wherein the fourth fold line and the fourth corner are configured to fold along the fourth fold line and the fourth corner to allow the fourth flexible side wall and the first flexible side wall to fold downward and inwardly toward the base and further wherein the fourth bendable insert strip is configured to fold at the fourth fold line and the fourth corner thereby flattening the fourth flexible side wall and the first flexible side wall toward the base;

placing the liquid-filled industrial object onto the base and holding the liquid-filled industrial object on the base within the first flexible side wall, the second flexible side wall, the third flexible side wall, and the fourth flexible side wall.

9. The method of claim 8 wherein the base comprises an absorbent material on a top surface of the base.

10. The method of claim 8 wherein the containment tray apparatus further comprises a duffel extending upwardly from the first flexible side wall and the second flexible side wall, further comprising the step of:

holding the liquid-filled industrial object within the containment tray apparatus on the base and within the duffel.

11. The method of claim 10 wherein the duffel comprises a cinch line disposed near a top of the duffel, wherein the cinch line is configured to allow tightening of the duffel around the liquid-filled industrial object contained on the base, further comprising the step of:

cinching the duffel around the liquid-filled industrial object contained within the containment tray apparatus on the base and within the duffel.

12. The method of claim 8 wherein the containment tray apparatus further comprises at least one strap extending from the first flexible side wall configured to hold the liquid-filled industrial object on the base, further comprising the step of:

extending the strap around the liquid-filled industrial object within the containment tray apparatus on the base.

13. A method of using a foldable and flexible containment tray comprising the steps of:

providing the flexible containment tray apparatus comprising:

a base formed from a flexible and liquid impervious fabric material;

a first flexible side wall extending perpendicularly from the base;

a second flexible side wall connected to the first flexible side wall and extending perpendicularly from the base, wherein the first flexible side wall and the second flexible side wall form a first corner where connected together;

a third flexible side wall connected to the second flexible side wall and extending perpendicularly from the base, wherein the third flexible side wall and the second flexible side wall form a second corner where connected together;

a fourth flexible side wall connected to the first flexible side wall and the third flexible side wall and extending perpendicularly from the base, wherein the fourth flexible side wall and the third flexible side wall form a third corner where connected together and wherein the fourth flexible side wall and the first flexible side wall form a fourth corner where connected together;

a first bendable insert strip disposed within the first flexible side wall, within the second flexible side wall, and around the first corner between the first flexible side wall and the second flexible side wall;

a second bendable strip disposed within the second flexible side wall, within the third flexible side wall, and around the second corner between the second flexible side wall and the third flexible side wall;

a third bendable strip disposed within the third flexible side wall, within the fourth flexible side wall, and around the third corner between the third flexible side wall and the fourth flexible side wall;

a fourth bendable strip disposed within the fourth flexible side wall, within the first flexible side wall, and around the fourth corner between the fourth flexible side wall and the first flexible side wall;

a first fold line in the first flexible side wall extending angularly from a first location at a bottom of the first flexible side wall adjacent the first corner to a second location at a top of the first flexible side wall, wherein the first fold line and the first corner are configured to fold along the first fold line and the first corner to allow the first flexible side wall and the second flexible side wall to fold downward and inwardly toward the base and further wherein the first bendable insert strip is configured to fold at the first fold line and the first corner thereby flattening the first flexible side wall and the second flexible side wall toward the base;

a second fold line in the second flexible side wall extending angularly from a third location at a bottom of the second flexible side wall adjacent the second corner to a fourth location at a top of the second flexible side wall, wherein the second fold line and the second corner are configured to fold along the second fold line and the second corner to allow the second flexible side wall and the third flexible side wall to fold downward and inwardly toward the base and further wherein the second bendable insert strip is configured to fold at the second fold line and the second corner thereby flattening the second flexible side wall and the third flexible side wall toward the base;

a third fold line in the third flexible side wall extending angularly from a fifth location at a bottom of the third flexible side wall adjacent the third corner to a sixth location at a top of the third flexible side wall, wherein the third fold line and the third corner are configured to fold along the third fold line and the third corner to allow the third flexible side wall and the fourth flexible side wall to fold downward and inwardly toward the base and further wherein the third bendable insert strip is configured to fold at the third fold line and the third corner thereby flattening the third flexible side wall and the fourth flexible side wall toward the base;

a fourth fold line in the fourth flexible side wall extending angularly from a seventh location at a bottom of the fourth flexible side wall adjacent the fourth corner to an eighth location at a top of the fourth flexible side wall, wherein the fourth fold line and the fourth corner are configured to fold along the fourth fold line and the fourth corner to allow the fourth flexible side wall and the first flexible side wall to fold downward and inwardly toward the base and further wherein the fourth bendable insert strip is configured to fold at the fourth fold line and the fourth corner thereby flattening the fourth flexible side wall and the first flexible side wall toward the base; and wherein the base is configured to hold a liquid-filled industrial object therein during transport within the first, second, third, and fourth flexible side walls;

folding the first flexible side wall and the first bendable insert strip at the first fold line;

folding the first corner between the first and second flexible side walls; and pushing the first flexible side wall and the second flexible side wall inwardly toward the base thereby flattening the first flexible side wall and the second flexible side wall toward the base forming a folded configuration.

14. The method of claim 13 further comprising the step of:

folding the base along a first base fold line to form a folded containment tray apparatus.

15. The method of claim 14 further comprising the step of:

folding the folded containment tray apparatus along a second base fold line to form a double-folded containment tray apparatus.

* * * * *